US005655948A

United States Patent [19]

Yapel et al.

[11] Patent Number: 5,655,948

[45] Date of Patent: Aug. 12, 1997

[54] COATER DIE GRINDING AND FINISHING METHOD

[75] Inventors: Robert A. Yapel, Oakdale; Thomas M. Milbourn, Mahtomedi, both of Minn.; Ronald A. Hanke, Hudson, Wis.; Alberto Goenaga; Mark E. Ebensperger, both of St. Paul, Minn.

[73] Assignee: Minnesota Mining and Manufacturing Company, St. Paul, Minn.

[21] Appl. No.: 464,957

[22] Filed: Jun. 5, 1995

[51] Int. Cl.[6] ..... B24B 1/00

[52] U.S. Cl. ..... 451/28; 451/63

[58] Field of Search ..... 451/28, 123, 296, 451/528, 534, 533, 539, 63, 152

[56] References Cited

U.S. PATENT DOCUMENTS

| | | | |
|---|---|---|---|
| 1,728,796 | 9/1929 | Hoskinen . | |
| 2,441,003 | 5/1948 | Bieberich et al. | 451/123 |
| 2,450,077 | 9/1948 | Biebrich et al. | 451/123 |
| 3,427,751 | 2/1969 | Lanman . | |
| 4,043,080 | 8/1977 | Maxwell | 451/123 |
| 4,287,749 | 9/1981 | Bachrach et al. | 72/467 |
| 4,444,628 | 4/1984 | Furukawa et al. | 204/29 |
| 4,617,764 | 10/1986 | Reibakh . | |
| 4,625,592 | 12/1986 | Bayens | 76/107 C |
| 4,644,703 | 2/1987 | Kaczmarek et al. | 451/533 |
| 4,936,052 | 6/1990 | Nagase et al. | 451/152 |
| 5,307,593 | 5/1994 | Lucker et al. | 451/63 |
| 5,358,193 | 10/1994 | Madsen et al. | 242/342 |
| 5,377,927 | 1/1995 | Erickson et al. | 242/346 |
| 5,454,844 | 10/1995 | Hibbard et al. | 51/295 |

*Primary Examiner*—James G. Smith
*Assistant Examiner*—Derris H. Banks
*Attorney, Agent, or Firm*—Gary L. Griswold; Walter N. Kirn; Charles D. Levine

[57] ABSTRACT

Methods of finishing and microfinishing the edges of a die component are disclosed. Each edge is polished to finish the edge of the die component to a smoother finish than the rest of the die component. This eliminates the incidence of undesirable streaking defects in the coating. The grinding and polishing includes placing a grind fixture adjacent the die component contiguous with the edge to present a grind fixture surface coplanar with the first surface of the edge, then grinding and polishing together the first surface of the edge of the die component and the adjacent grind fixture surface are polished. This is repeated for the second surface of the edge.

18 Claims, 2 Drawing Sheets

COATER DIE GRINDING AND FINISHING METHOD

TECHNICAL FIELD

The present invention relates to manufacturing die components. More particularly, the present invention relates to grinding and finishing die components.

BACKGROUND OF THE INVENTION

Known coater die component methods of manufacture call for an 8 to 16 microinch finish on all of the surfaces. The surfaces are ground to this finish. The surface also should be unbroken with deburred edges at the die lips. The die components are ground along their length to minimize formation of a "sawtooth" pattern on the coating edges which would lead to catastrophic levels of streaking. The die component edges can be deburred by hand if necessary, possibly with a non-woven material or a suitable sharpening stone. There is no further micropolishing. The die component edges are ground to the same finish as the rest of the component. This does not always lead to sufficiently polished surfaces and causes streaking in the coating of products. Even freshly ground dies made by the best known methods can still produce streaks.

Typically, the surfaces of the die are ground using a grind wheel to surface grind each surface of each die component which is contacted by coating fluid during coating. Known grinding of mater dies is shown in FIGS. 1A and 1B. These Figures show using a grinding wheel 10 to grind two surfaces 12, 14 of the three surfaces of the die component 18 edge. (The third surface 16 also will be ground.) The simplest way to make the die parts is to do the final surface grinding along the die length. This method, however, leads to formation of a burr on the die edges that must be removed, and leads to an uneven edge morphology.

SUMMARY OF THE INVENTION

One version of this invention is a method of microfinishing the edge of a die component. The edge is formed by the intersection of first and second surfaces of the die component. After the die component is machined by known methods, the edge is polished to finish the edge of the die component to a smoother finish than the rest of the die component. This eliminates the incidence of undesirable streaking defects in the coating. The polishing includes placing a grind fixture adjacent the die component contiguous with the edge being microfinished to present a grind fixture surface coplanar with the first surface of the edge. After the grind fixture is placed, the first surface of the edge of the die component and the adjacent grind fixture surface are polished together to minimize burr formation at the edge. A grind fixture is placed adjacent the die component contiguous with the edge being microfinished to present a grind fixture surface coplanar with the second surface of the edge. After the grind fixture is placed, the second surface of the edge of the die component and the adjacent grind fixture surface are surface ground and polished together to minimize burr information at the edge.

In other embodiments, the grind fixture used in the second placing step could be the same or differ from that used in the first placing step. Also, the respective grind fixtures can be removed after the respective polishing steps. At least one of the polishing steps can include polishing the surface in two or more successive steps and the edge can be polished to a finish of less than 8 microinches.

In another version of the invention, a die component is ground and polished in a novel manner. In this version, a grind fixture is placed adjacent the die component contiguous with the edge to present a grind fixture surface coplanar with the first surface of the edge. After placement, the first surface of the edge of the die component and the adjacent grind fixture surface are ground together. Then, the first surface of the edge of the die component and the adjacent grind fixture surface are polished together to minimize burr formation at the edge. A grind fixture is placed adjacent the die component contiguous with the edge being micro finished to present a grind fixture surface coplanar with the second surface of the edge. After placement, the second surface of the edge of the die component and the adjacent grind fixture surface are ground together. Then, the second surface of the edge of the die component and the adjacent grind fixture surface are polished together to minimize burr formation at the edge.

Where the die component has additional edges formed by the intersections of respective first and second surfaces, the method includes repeating the two sets of placing, grinding, and polishing steps for each edge. Also, for some surfaces two grind fixtures can be used, one grind fixture at each end of the surface.

In one embodiment, the polishing step for the first surface is conducted after the grinding step for the first surface without any intermediate steps, and the polishing step for the second surface is conducted after the grinding step for the second surface without any intermediate steps. In another embodiment, the grinding steps for the first and second surfaces are conducted before the polishing steps for the first and second surfaces.

The method can also include the step of fabricating a grind fixture to fit the die component and the grind fixture can be fabricated from the same material as that of the die component.

The step of placing a grind fixture adjacent the die component contiguous with the edge being microfinished to present a grind fixture surface coplanar with the second surface of the edge can use the same or a different grind fixture than is used for the first surface of the edge.

Also, the method can include fabricating the grind fixtures to fit the die component. The step of fabricating the grind fixture for use with the second surface of the edge can be performed after the step of polishing the first surface of the edge is completed.

With this method, the surfaces can be ground in a direction nonparallel to the edge while still eliminating grind lines in the finished die surface. Also, the polishing steps can be performed in two or more successive steps, and the edge can be polished to a roughness finish of less than 8 microinches.

DETAILED DESCRIPTION

Figure 1B:
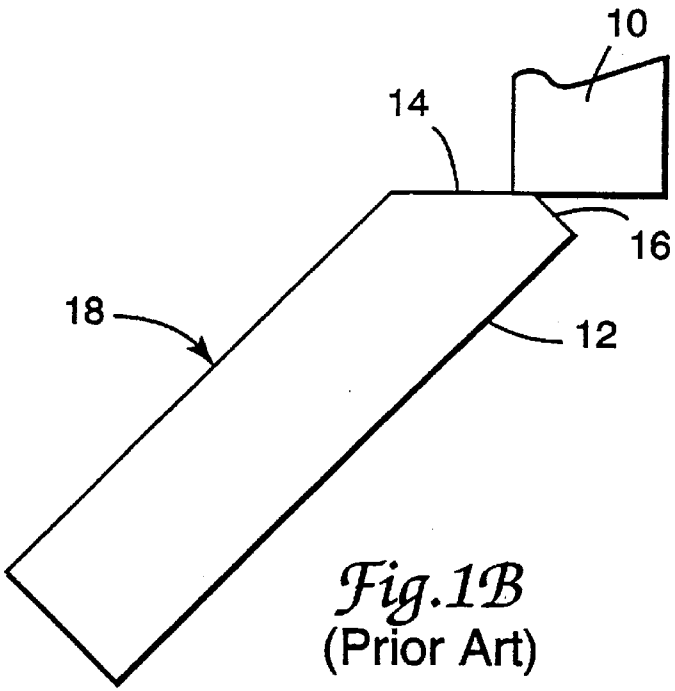
Fig. 1B (Prior Art)
FIGS. 1A and 1B are schematic views of two surfaces of a die being ground in a known manner.
Figure 1A:
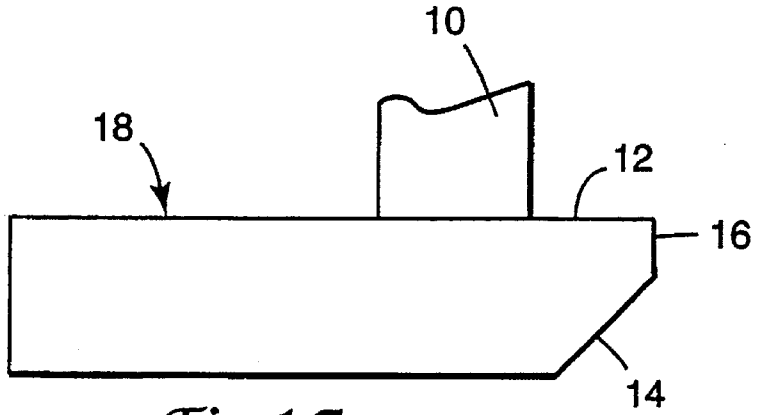
Fig. 1A (Prior Art)
Figure 2:
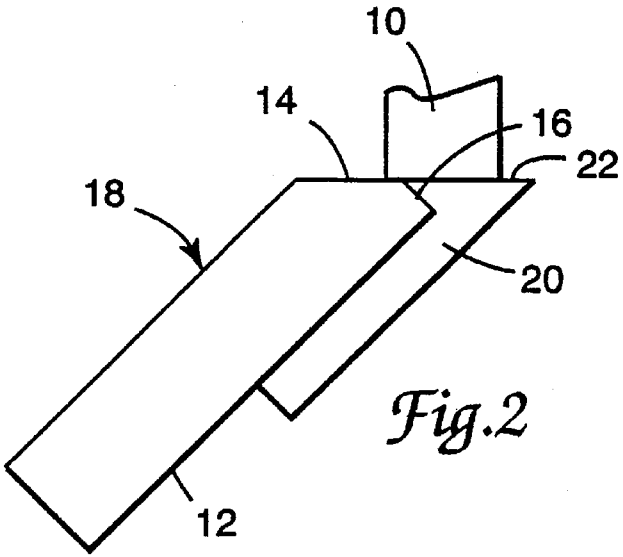
FIG. 2 is a schematic view of one surface of a die being ground using a ground fixture for the last surface according to this invention.

This invention is a method of preparing die coaters, such as extrusion coaters including plain extrusion coaters, knife coaters, slot fed knife coaters, slide coaters, fluid bearing coaters, flow bars for gravure or roll coaters, and die-fed kiss transfers. Grinding the last surface of a die part using a fixture to back-up the die edge minimizes burr formation. In FIG. 2, a grind fixture 20 is attached to the die component 18 to provide a surface 22 adjacent the surface 14 being ground by the grinding wheel 10. This procedure can be performed while the die component 18 is horizontal and the last surface is angled by using a dressed wheel to allow for the die angle shape. Alternatively, as shown in FIG. 2, this procedure can be improved by tilting the die component 18 so that the grind surface 14 is level. This improves the flatness and straightness of the die surfaces and edges by better using the grinding wheel 10. Even with this method, some burr formation occurs, requiring deburring and causing a non-uniform irregular edge (if viewed under microscopic examination) which can yield coating imperfections.

Figure 3A:
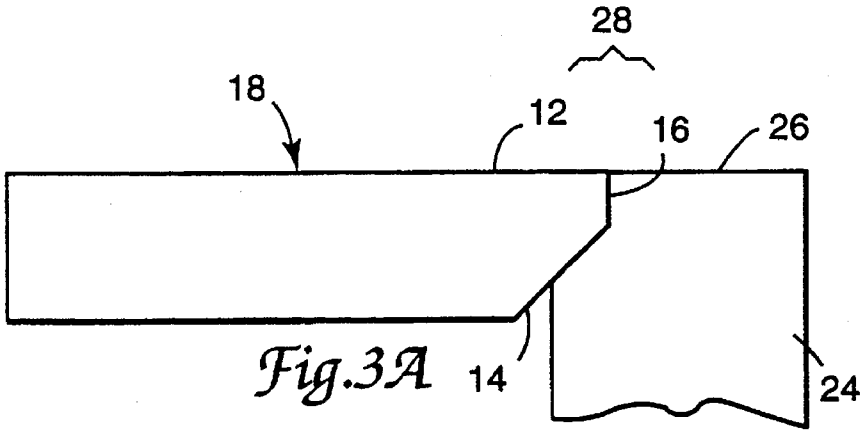
FIGS. 3A, 3B, and 3C are schematic views of a die component using grind fixtures during grinding of each surface according to this invention.
Figure 3B:
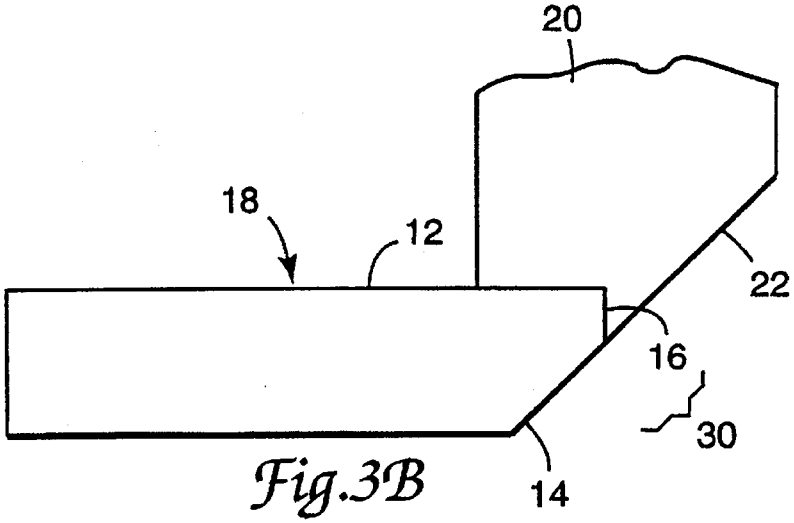
Figure 3C:
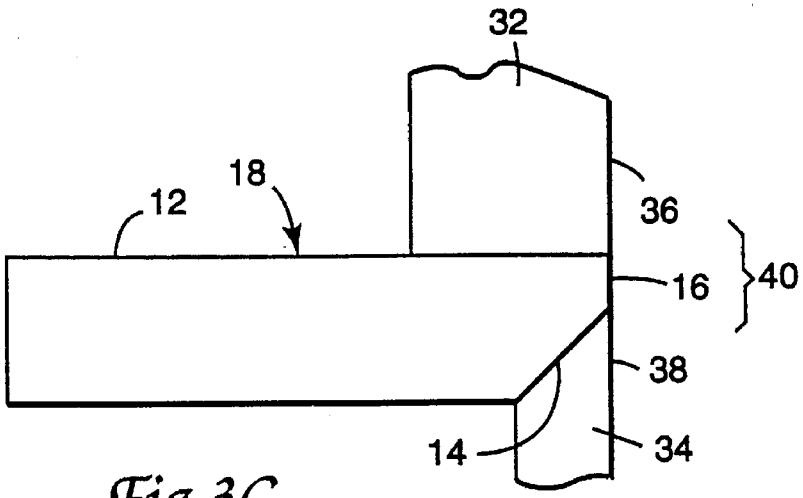

FIGS. 3A, 3B, and 3C show a further method of this invention, as applied to a generic die part 18 such as a die half used for extrusion coating. In this embodiment, all of the surfaces 12, 14, 16 adjacent to a slot exit, coater bead, or knifing region are ground using respective fixture assemblies to stabilize the edge and minimize burr formation. This improves over the system in which a fixture is used only on the grind of the last surface. After each surface is ground, before the fixtures are removed, the surface in the vicinity of the die edges is polished. (In alternative embodiments, the grinding of each surface can be completed before the polishing of the surfaces.) Preferably, the polishing is done along the die length direction. The result of this finishing procedure is a die part 18 with edges and surfaces in the vicinity of the edge that are straight, flat, and free of microscopic irregularities or defects which can produce fine streaking in a coating. Further, the use of the grinding fixtures prevents the geometry of the die part from being altered, which might degrade the performance of the coater die.

The step-by-step procedure is as follows. First, as shown in FIG. 3A, a grind fixture 24 is fabricated and assembled to the die component 18. Then the die component surface 12 along with the surface 26 of the fixture 24 are ground together. Then, the edge region 28 is polished to a mirror (roughness of less than 4 microinches) finish. As shown, the fixture 24 fits around both surfaces 14, 16 of the die component 18. These steps are repeated for the other two surfaces 14, 16. First, as shown in FIG. 3B, a grind fixture 20 is fabricated and assembled to the die component 18. Then the die component surface 14 along with the surface 22 of the fixture 20 are ground together. Then, the edge region 30 is polished to a mirror finish. As shown, the fixture 20 fits around both surfaces 12, 16 of the die component 18. As shown in FIG. 3C, two grind fixtures 32, 34 are fabricated and assembled to the die component 18. Then the die component surface 16 along with the surfaces 36, 38 of the fixtures 32, 34 are ground together. Then, the edge region 40 is polished to a mirror finish. As shown, each fixture 32, 34 fits over a respective surface 12, 14 of the die component 18. The fixture 34 need not cover the entire surface 14.

Fabricating the second, third, and fourth grind fixtures 20, 32, 34 during the procedure rather than together with the first grind fixture 24, enables these fixtures to be custom-made to fit the die component at the time they will be used. Otherwise, the grinding of the first surface 12 could cause the second, third, and fourth fixtures 20, 32, 34 to misfit, resulting in inferior edges. Also, the fixtures can be formed of the same or different material as that of the die.

Figure 4:
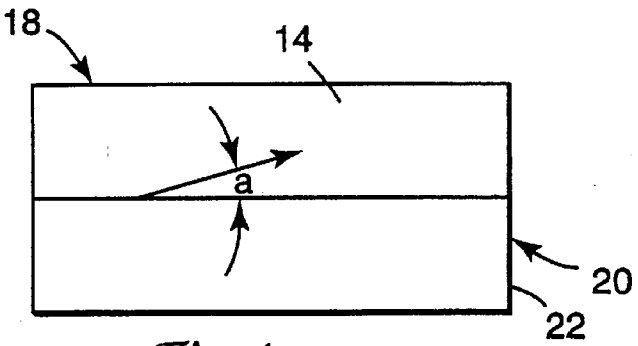
FIG. 4 is a schematic view of a die component showing a non-zero angle of grinding according to this invention.

In a further embodiment of this invention, the direction of grinding the die can be changed as shown in FIG. 4 (using the surface 14 as an example). With known methods, it was necessary to grind only along the die length direction, with the angle a=0, because for a≠0, the grind lines in the die surface (having a roughness typically of more than 8 microinches), would tend to channel the coating liquid in the die slot, causing streaking. More importantly, the grind lines on the intersection surfaces which form the edge form a sawtooth pattern which catastrophically creates streaking in the coatings. In this invention, it is now possible to choose angle where a≠0, such as angles of a≧0. These non-zero angles further reduce the tendency of burr formation on the grind. This works in this invention because the grind lines are removed in the lapping/polishing steps before disassembly of the fixtures. (The finish, or roughness, is the finely spaced surface-texture irregularities resulting from the manufacturing process. The roughness, also known as the roughness-height index value, is a number that equals the arithmetical average deviation of the minute surface irregularities from a hypothetical perfect surface, expressed in microinches.)

Any suitable polishing, such as lapping, vapor honing, grit blasting, and other methods, can be used to polish the edges after the die is ground. This micropolishing step finishes the die at the lip edges to a much smoother finish than the rest of the die to eliminate the incidence of undesirable streaking defects, such as die lines, in the coating. The die lip edges are finished, by micropolishing, to less than 8 microinches (known coater die finishing methods create an 8 to 16 microinch finish on the ground surfaces). The various sides of the die that form the edges can be polished separately, as described above, to optimize the polishing while avoiding unnecessary rounding of any of the edges. This maintains the coating performance of the die while reducing streaking.

One method involves micropolishing the edge of the die with lapping film. The lapping film can be 3M Imperial Lapping Film from Minnesota Mining and Manufacturing Company, St. Paul, Minn., in grades of about 1 micron or finer. The die edge is lapped, while being wetted with oil. For dies that are small enough, the lapping film itself could be attached to a flat surface (such as a granite table) and the die can be reciprocated along its length.

Also, the die edges can be polished in two or more successive steps. For example, the edges could be polished first to a coarse finish using 1 micron or larger grade lapping film, then to an intermediate finish using 0.3 micron grade lapping film, and finally to a fine finish using 0.05 micron or smaller grade lapping film. This translates into minimum roughness of the edges as these die surfaces intersect to form the edges. It is desirable to provide a finish in the vicinity of the edge that is as smooth as attainable for the underlying material for the coater die part. A 1 microinch finish or preferably less is a typical goal, depending on the material. Additional initial steps of polishing with very coarse finishes of 20, 50, 100 microns, and larger grade lapping films can also be performed.

Additionally, the die edges can be finished with a compound angle. For example, the angle at the die edge tip could be 90° (as evident only under large magnification) while the remainder of the die edge could form an acute angle.

Tests have shown that lapping more that the edges of the die, such as into the die slot, will not further improve coating performance and would not reduce streaking. Thus, over-polishing all of the surfaces of the die is not necessary. It is a feature of this invention, to finish the die edges finer than the rest of the die.

This method of micropolishing eliminates defects that are too small to see or feel and can eliminate defects that are sometimes too small to see under a microscope. For example, in many situations with photochemical coatings (which use high viscosity coating fluids), examination of the coated film without photographically imaging the film would not reveal the presence of a defect; this means that there is little chance to find a defect and avoid selling defective film to customers. In the development of this invention, the inventors recognized that even these extremely small defects can affect coating quality, particularly with sensitive photochemical coatings. It was not recognized before this invention, nor would it have been obvious, that such small defects were a concern—that for example in dual layer extrusion coating many of these defects would cause a streak at the die edge but the coating surface would level downstream. Yet interdiffusion of functional components and the lack of leveling at the layer interface resulted in streak defects in the functional product. Also, because the results of the micro finishing are not visible except under very large magnification, it is not apparent that this method would improve coating quality involving much larger streaks.

This method greatly reduces the number and intensity of coating streaks caused by non-uniformities in the die edge lip. This is a particular importance with the coating of fluids composed of solutions of polymeric components, especially at concentrations that result in shear viscosity greater than 2–5 poise, because of reduced settling rate of the streaks that results in greater sensitivity to streaking.

We claim:

1. A method of micro finishing the edge of a die component comprising, after the die component is machined by known methods, the step of polishing the edge to finish the edge of the die component to a smoother finish than the rest of the die component thereby to reduce the incidence of undesirable streaking defects in the coating, wherein the edge is formed by the intersection of first and second surfaces of the die component, and wherein the polishing step comprises:

placing a grind fixture adjacent the die component contiguous with the edge being microfinished to present a grind fixture surface coplanar with the first surface of the edge;

polishing the first surface of the edge of the die component and the adjacent grind fixture surface together to minimize burr formation at the edge;

placing a grind fixture adjacent the die component contiguous with the edge being microfinished to present a grind fixture surface coplanar with the second surface of the edge; and polishing the second surface of the edge of the die component and the adjacent grind fixture surface together to minimize burr formation at the edge.

2. The method of claim 1 wherein the second placing a grind fixture step comprises placing a grind fixture that is different from the grind fixture placed in the first placing a grind fixture step.

3. The method of claim 1 further comprising after the polishing the first surface step, removing the grind fixture; and after the polishing the second surface step, removing the grind fixture.

4. The method of claim 1 wherein at least one of the polishing steps comprises polishing the surface in two or more successive steps.

5. The method of claim 1 wherein the polishing step comprises polishing the edge to a finish of less than 8 microinches.

6. A method of finishing a die component having at least one edge defined by first and second intersecting surfaces and comprising the steps of:

placing a grind fixture adjacent the die component contiguous with the edge to present a grind fixture surface coplanar with the first surface of the edge;

grinding the first surface of the edge of the die component and the adjacent grind fixture surface together;

polishing the first surface of the edge of the die component and the adjacent grind fixture surface together to minimize burr formation at the edge;

placing a grind fixture adjacent the die component contiguous with the edge being microfinished to present a grind fixture surface coplanar with the second surface of the edge;

grinding the second surface of the edge of the die component and the adjacent grind fixture surface together; and polishing the second surface of the edge of the die component and the adjacent grind fixture surface together to minimize burr formation at the edge.

7. The method of claim 6 wherein the polishing step for the first surface is conducted after the grinding step for the first surface without any intermediate steps, and wherein the polishing step for the second surface is conducted after the grinding step for the second surface without any intermediate steps.

8. The method of claim 6 wherein the grinding steps for the first and second surfaces are conducted before the polishing steps for the first and second surfaces.

9. The method of claim 6 wherein the die component has additional edges formed by the intersections of respective first and second surfaces, and further comprising repeating the two sets of placing, grinding, and polishing steps for each edge.

10. The method of claim 6 further comprising the step of fabricating a grind fixture to fit the die component.

11. The method of claim 10 wherein the step of fabricating a grind fixture comprises fabricating the grind fixture from the same material as that of the die component.

12. The method of claim 6 wherein the step of placing a grind fixture adjacent the die component contiguous with the edge being microfinished to present a grind fixture surface coplanar with the second surface of the edge comprises placing a different grind fixture than is used for the first surface of the edge.

13. The method of claim 12 further comprising the step of fabricating the grind fixtures to fit the die component.

14. The method of claim 13 wherein the step of fabricating the grind fixture for use with the second surface of the edge is performed after the step of polishing the first surface of the edge is completed.

15. The method of claim 6 wherein at least one of the steps of placing a grind fixture adjacent the die component contiguous with the edge comprises placing two grind fixtures adjacent the die component contiguous with the edge, wherein one grind fixture is located at each end of the surface.

16. The method of claim 6 wherein the steps of grinding the surfaces comprises grinding in a direction with the angle $a \neq 0$, while eliminating grind lines in the finished die surface.

17. The method of claim 6 wherein at least one of the polishing steps comprises polishing the surface in two or more successive steps.

18. The method of claim 6 wherein the polishing step comprises polishing the edge to a finish of less than 8 microinches.

* * * * *